United States Patent [19]

Raitport

[11] 4,017,008

[45] Apr. 12, 1977

[54] SPRAY CONTAINER

[76] Inventor: Eli Raitport, 1807 Mower St., Philadelphia, Pa. 19152

[22] Filed: Oct. 25, 1973

[21] Appl. No.: 409,385

Related U.S. Application Data

[63] Continuation-in-part of Ser. No. 102,330, Dec. 29, 1970, abandoned.

[52] U.S. Cl. ..... 222/94; 222/95

[51] Int. Cl.[2] ..... B65D 35/22

[58] Field of Search ..... 222/92, 94, 95, 96, 222/103, 106, 107, 173, 183, 202, 203, 206, 209, 214, 215, 372, 373, 386, 386.5, 387, 389, 394, 401; 92/34, 35, 37, 38, 39, 40, 41, 42, 44, 47, 92; 150/.5; 220/8, 85 B

[56] References Cited

UNITED STATES PATENTS

| | | | |
|---|---|---|---|
| 1,230,052 | 6/1917 | Stevenson | 222/95 |
| 2,723,050 | 11/1955 | Montgomery et al. | 222/103 |
| 2,751,953 | 6/1956 | Grimm | 150/.5 |
| 3,380,632 | 4/1968 | Wilson | 222/94 |

*Primary Examiner*—Stanley H. Tollberg

[57] ABSTRACT

This invention pertains to a dispensing container, consisting of two bellows containers placed one into the other. Both containers are interconnected and collapse together. There is a mechanism integrally built with the external container to pressurize fluid substances between the walls of the containers, either the substance of the outer container may be dispensed; or the substance of the inner container may be dispensed. In either case no gas for propellant is used. The container is provided with a pair of scissor type jaws and levers to facilitate collapsing of the container and compression of the fluid.

17 Claims, 6 Drawing Figures

SPRAY CONTAINER

This application is continuation in part of application Ser. No. 102,330 filed on Dec. 29, 1970 with the title, "Method and Means for Beverage Containers in order to Prevent Separation of Carbonic Acid from Carbonic beverages and Method to Manufacture same" which is now abandoned.

The object of this invention is to provide a spray-can which does not need pressurized gas for propelling; and thus to prevent the imminent catastrophe to the world should the ozone layer be destroyed from the excessive "dump" of Freon into the atmosphere.

Another object of this invention is to provide a low-cost reusable spray can.

WORKING PRINCIPLE OF THIS INVENTION

Figures 1, 2, 3, 4, 5:
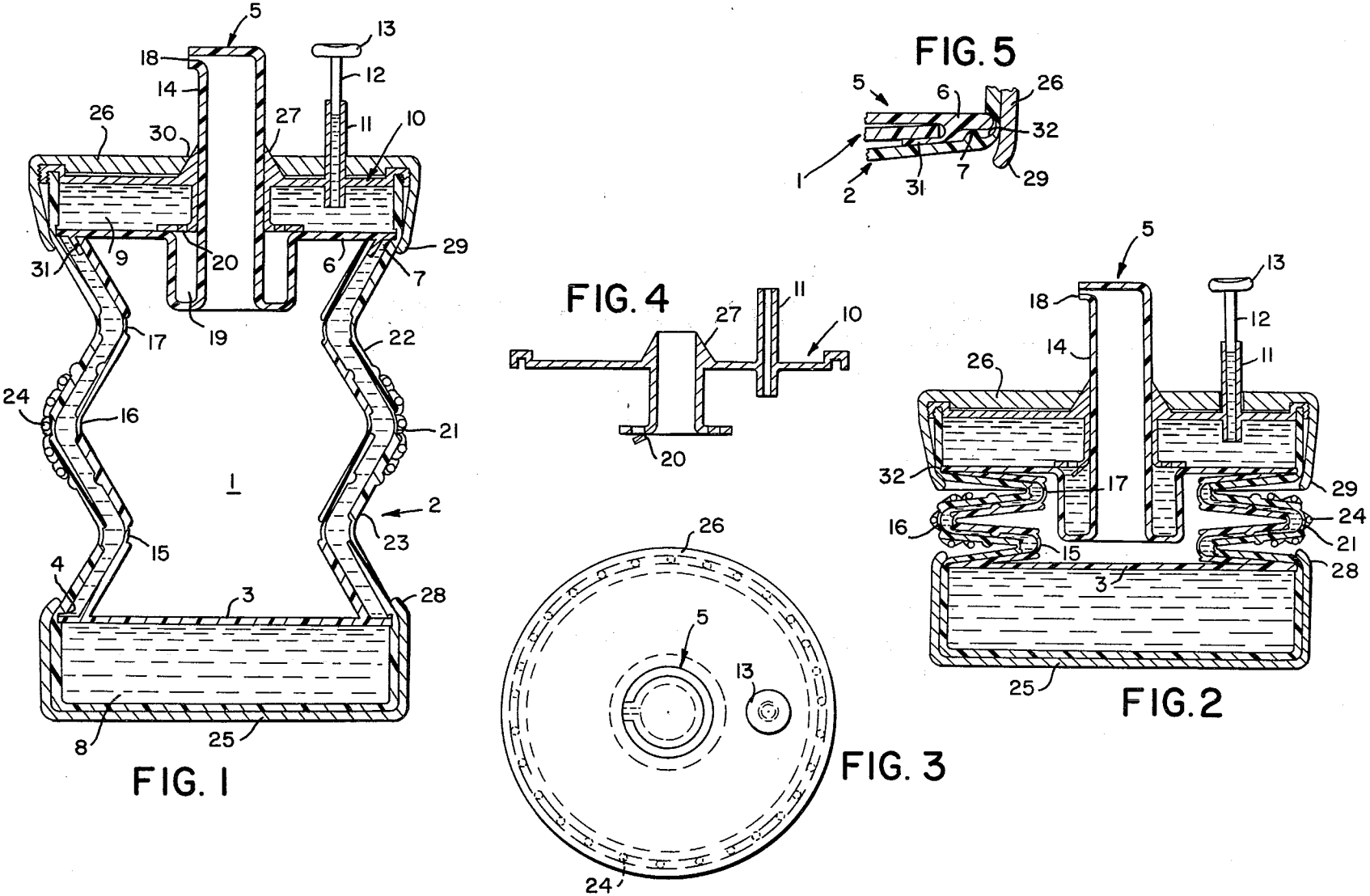
FIG. 1 and 2 depicts a sectional vertical view of a double container intended for a fine spray in full and empty positions respectively.
FIG. 3 is top view of that double container.
FIG. 4 depicts a section view of the cover for the external container.
FIG. 5 depicts a partially enlarged view of FIG. 2 at the top illustrating the connection between the containers and the covers.

The instant innovation consists of manipulation of hydraulic advantage and balancing of forces resulted from pressure in a double bellows container in such a way that despite the inner pressure the bellows are dynamically balanced at any angle of inclination of bellows; in other words, the forces resulted from inner pressure of the container, as they act upon the container, are so balanced as to prevent erection of the bellows.

Thus it permits relatively a slight external force to cause the bellows to fold dispensing the liquid under substantial pressure, eliminating the need for propellant gas. The invention is provided with scissor type jaws and levers to provide the force with mechanical advantage and convenience. The invention will be clearer in below description embodying the principle into an actual mechanism.

This invention could be used twofold: to spray the liquid lodged between the bellows; or to spray the content from the inner bellows. The advantages of either way is beyond the scope of this invention. Litte structural change is required for alternative of its applications. First we shall describe structure and operation for spraying substance from the outer container while the space of the inner container remains idle.

DESCRIPTION OF THE INVENTION (See FIGS. 1 and 2) Container (1) is placed inside the container (2) which is slightly larger, so that liquid could be contained between the two containers. By means of depressing a piston (12) pressure in generated in the external container and thrust is applied to the bottom and top of the inner container. Using the hydraulic advantage high pressure is generated in the liquid between the containers.

Both containers, the external and internal are basically the same. Only the bottom (3) of container (1) extends outwardly and engages the external container by the projection (4). The top (6) of the inner container is also extending outwardly and engaging external container by its projection (7) and groove (32).

The external container is also modified by straight (not a bellow) sections (8) and (9) at both ends of the container. This is an optional feature not essential to the invention itself. From the cover (10) of the external container, projects a tube (11) which is a cylinder for the piston (12). When force is applied depressing the outside container (2) and the piston (12), it exerts pressure on the liquid in the cylinder (11). This pressure is transmitted to the liquid in the compartment (9). Being that the engagement between cover (6) and projection (7) is not liquid tight, the pressure is transmitted to the substance between the walls of the two container (1) and (2) which is to be dispensed. Then the pressure is transmitted to the liquid in compartment (8) similarly, because the engagement of inner container (3) and projection (4) of the outer container is not liquid tight. Consequently the substance thrusts externally on the top and bottom of the inner container (1) and equals to $(A_2/A^1 \& A_1/A^1) \times F$; $A_2$ = the area of the top of the inner container (1) minus the area of the nozzle (14) $A_1$ = the area of the bottom (3) of the inner container; $A^1$ the area of the piston (12); F = the external force applied to depress the container and piton12. The above said thrust will tend to fold the joint of the bellows (15), (16), and (17); and counteracting the thrust at the end of the container (2) resulting from inner pressure and tending to erect the container.

Nozzle (18) is open to the atmosphere, thus preventing build-up of pressure within (1).

The container is in full equilibrium while the liquid between the containers may be highly pressurized; because (8) and (9) is in equilibrium, thus the pressure in these compartments tending to erect and compress the containers simultaneously (See force diagram) and pressure on bellows (15) is equilibrated by pressure on (16) and so on; therefore the device can be pressurized and remain in collapsed position; it will not erect like conventional bellow containers, due to the inner thrust at the end of container.

Consequently the liquid in container may be pressurized by operating piston (12) by means of the hook (13) which is connected to the jaw (34); then pressure applied on (26) and (25) through plates (37) and (38) by squeezing the scissor type jaws (33) and (34) it will fold the bellows and increase the internal pressure to the level required for atomization. Thus through the operation of the piston (12) the pressure of the liquid may rise approximately to 65 lb. p.s.i. then squeezing the jaws (33) and (34), without great strain, even a feeble person could raise the pressure to 70 lb. p.s.i.; that is the level normally required for high atomization.

When the jaws are squeezed, automatically hook (13) will displace further piston (12) and open a built in valve in (11) into orifice (not shown) then due to pressure drop at the port of the orifice the liquid will atomize.

The convolutes (22) are made in such a way in relation to convolute (17) that when it folds the inner periphery of the convolutes (of smaller diameter) of the inner and outer container engaging first, and gradually the entire surface are of these convolutes come in contact with each other. Since engagement of the convolutes takes place while liquid is pressurized between the containers, the entire force transmitted through the levers (33) and (34) is concentrated on a small area and transmitting it to the entire system with a substantial hydraulic advantage.

Consequently, the atomized spray will be continuous. As the liquid between the wall of the container is squeezed out of the container it will take the shape shown in FIG. 2.

Figure 6:
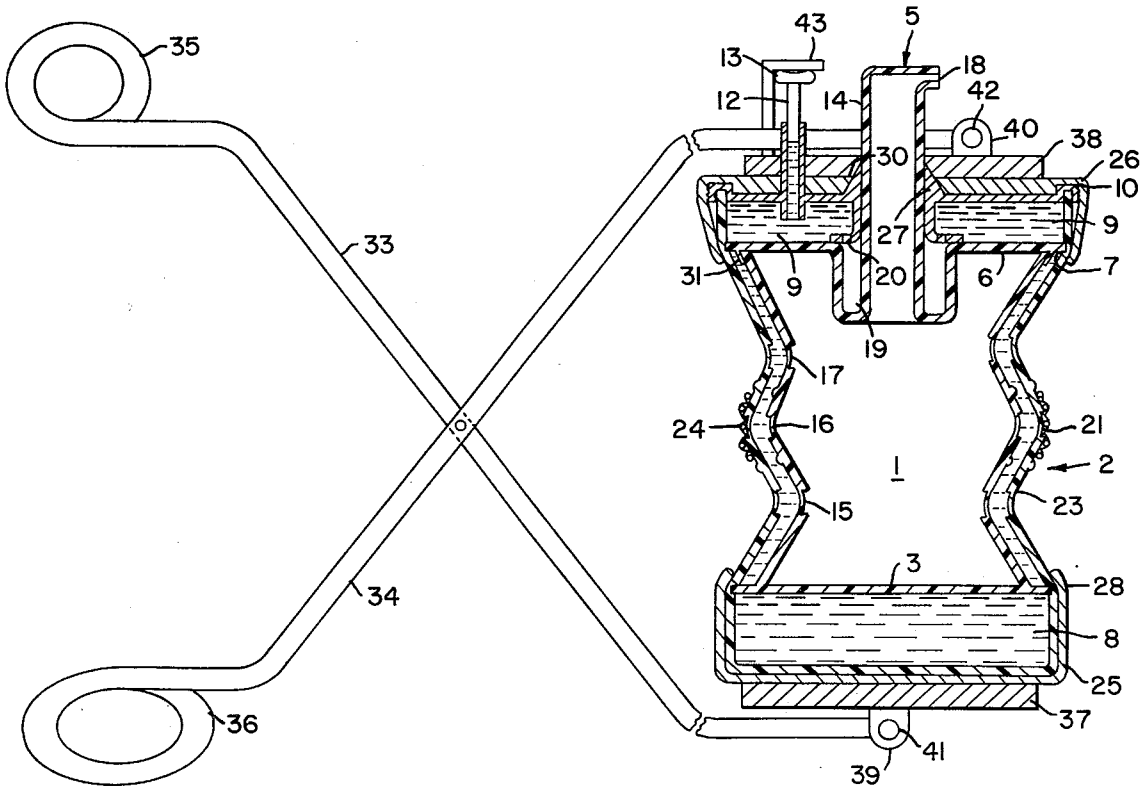
FIG. 6 depicts a section view of said container with jaws and levers. These jaws and levers facilitate holding of the can and permit to exert more pressure than it is possible by a finger.

Spraying may be interrupted at any time for any desired length of time just by releasing the external pressure on (13), (26) and (25) (which is accomplished by means of jaws as shown in FIG. 6 or by any other means). The container will then remain in the partially folded position for any period length of time; because the external pressure will be removed; then the pressure of the liquid will drop, but its action on the convolutions will be balanced as aforsaid; so the container will remain in its position ready for the spray to start as soon as external pressure is applied.

In the event a weak material is used for the container (1) and (2), it should be reinforced by a wire grid (24) shown imbedded into the container (2). FIGS. 1 & 2) at section (21).

Compartments (8) and (9) are also subjected to high hoop stresses, therefore they are reinforced by steel cups (25) and (26). The ends (28) and (29) of cups (25) and (26) are bent inwardly; this helps to retain the engagement between the inner and outer container.

(27) is a sealing neck extending from cover (10) of the external container. (30) is a hole in the cup (26) cut perhaps conically. The sealing neck (27) is of a conical shape; so when the cup (26) is forced on the container (2) by suitable means, the borderline of hole (30) interferes with the conical neck (27) and squeezes it around the tube (14) to perfect a food seal.

It is here intended that the entire cover (10) would be manufactured from a soft plastic, however, this is not a limitation. However, if (10) is soft the cups (25) and (26) would serve to prevent plastic deformation of compartment (8) and (9) respectively.

These compartments (8) and (9) should not deform at all. Even slight elastic deformation of these compartments would require longer strokes for the piston (12), which is undesirable.

It might be more economical to use said two cups than to employ its alternatives, in order to prevent deformation of compartments (8) and (9).

FIG. 5 depicts a partially enlarged view of FIG. 2 at the top, illustrating the connection between the containers and their covers, and specifically the position of the skirt (31) of the inner cover (6) and position of the top convolution of container (1); in its "empty" position. Initially, cover (6) is snapped over the container (1); then the seal is accomplished by "hydroclaving" through use of the pressure in compartment (9) by means of working the piston (12) and jaws, as above explained. (32) is a grooved bearing in which the outer edge of (6) glides while the bellows are folding. The seal is accomplished by the skirt (31) which is pressed to (1) by thrust of pressurized liquid between the walls of (1) and (2).

The mechanism which prevents abrupt steps in folding of the bellows and permits parallel folding is the groove (32) and its humps (7) at the lower end of the groove (FIG. 5). The projection of (6) fits closely into that groove which is shaped to the same radial contour. Hence the projection of (6) is constrained between the upper end of the groove (32) and hump (7). Because the contour of projection of (6) is similar to groove (32) it fits and pivots like a ball in a socket at the bearing point (7), permitting close to 90° rotation. Of course it is not expected more than 60° rotation to be needed. Similar arrangement (4) exists at the lower end of the container (3).

The jaws are pivotably connected to the plates (37) and (38) by means of pins (41) and (42) and sockets (39) and (40) respectively, thus providing latitude for changing angles when the container is squeezed as shown in FIG. 2.

At the bending points of the jaws (33) and (34) additional arrangement for variation of angles might be desirable. (35) and (36) are griphandles for convenience.

The plates (37) and (38) may be removably attached to the container (2) for more convenient reusability. The levers may be equipped with a ratchet (not shown) preventing expansion of container in event a singular bellows is used.

In case this invention is used for dispensing the substance rather from the inner bellows, in such event no valve would be in piston (12). The liquid between the bellows is used to support the inner bellows (thus allowing to use much weaker material for the inner container), and to transmit pressure through hydraulic advantage to the substance inside of inner bellows. The substance is then dispensed through orifice (18). Excessive liquid from between containers force itself into projection (19) through valve (20). That occurs when container is collapsing.

Otherwise the operation and construction of this innovation is pretty much the same in either case. However in later case - external force must be used to counterbalance the thrust of the pressure in the inner bellows tending to erect the container.

It is desirable to use the inner bellows for expensive merchandise, because using the between the bellows for the merchandise may cause waste of trapped merchandise in compartments (8) and (9). While in the inner bellows projection (19) displaces the liquid from the center, when it is folded. (FIG. 2).

It should be understood that the invention is not limited thereto, since many modifications may be made; within the true spirit and scope of invention.

I claim:

1. A collapsible container for dispensing comprising two bellows type containers and at least one orifice, whereas one of said bellows being smaller, the other being larger, each of said bellows has at least one opening, the said smaller container placed within the said larger bellows - container forming a space therebetween, said space being filled with flowable substance, said smaller container provided for with an extension which protrudes through the said opening of said larger bellows, each of said bellows has at least one end plate, said end plates of said smaller bellows projects outwardly, said projection fits into grooves provided for on the inside of the walls of said larger bellows forming an interlocking means for both said bellows in such a way that when pressure is applied to said larger container both said bellows are biased to collapse simultaneously, whereas a separate compartment is formed at the end of the container between the ends of said smaller and said larger bellows, and said compartment is filled with a flowable substance.

2. A container as defined in claim 1, further comprising means to generate hydraulic pressure within the flowable substance in said space between said bellows type containers, whereas said flowable substance within said space between said bellows type containers, becomes pressurized and it is dispensed.

3. A bellows container as defined in claim 1, further comprising a recess in the central area of said inner bellows container.

4. A bellows type container as defined in claim 1, further comprising at least one tube built in at least one end plate of the said larger bellow, one end of said tube is open into said compartment between the ends of said smaller and larger bellows, a piston traveling in said tube, an orifice in said piston, whereby depressing the bellows said substance from said compartment will be dispersed through said orifice.

5. A bellows type container as defined in claim 1, further comprising a structure encompassing said outer bellows, at least partially.

6. A bellows type container as defined in claim 1, further comprising a collapsible outer structure encompassing said outer bellows, at least partially.

7. A bellows type container as defined in claim 6, further defined by imbeddment of an outer structure into the bellows whereby said bellows are reinforced.

8. A bellows container as defined in claim 1, further comprising a scissor type pair of jaws, pivotably and exteriorally connected to each end of the larger said bellows; whereas said jaws embracing said container and whereas by clamping said jaws, said bellows are biased to fold.

9. A container as defined in claim 1, further comprising flowable substances within the said smaller container whereas applying hydraulic pressure to the said smaller container, through the said flowable substance between the containers, the said substance within smaller container is dispensed.

10. A bellow container as defined in claim 8, further comprising means to generate hydraulic pressure within the said larger bellows and means integral with said jaws to actuate said means generating hydraulic pressure.

11. A bellows container as defined in claim 1, further comprising a metal cap containing at least one end compartment of said outer bellows.

12. A bellows container as defined in claim 1, further comprising a hump in said groove, whereby said projection pivots on said hump when said bellows container is collapsing.

13. A spray container combining at least one type container a pair of jaws and levers, at least one piston to pressurize liquid in said container, and at least one orifice, whereas said jaws are embracing said container from ends, whereas said jaws are exteriorily, pivotably, thrust on said piston, wherefore, while clamping the said jaws said piston is displaced to raise the pressure in said container and simultaneously said jaws causing collapse of said container, whereby causing dispensing.

14. A spray container as defined in claim 13, further comprising means to generate hyraulic pressure integrally built into the said container and a hook integrally connected to one of said jaws, whereas said hook operates said means to generate hydraulic pressure within said container.

15. A spray container as defined in claim 13, further comprising an outer structure.

16. A spray container as defined in claim 13, further comprising a collapsible outer structure.

17. A spray container as described in claim 16, further defined by the outer structure being imbedded into the walls of said container.

* * * * *